US007886797B2

(12) United States Patent
Batzer et al.

(10) Patent No.: US 7,886,797 B2
(45) Date of Patent: Feb. 15, 2011

(54) APPARATUS FOR AUTOMATICALLY CLOSING ENVELOPES

(75) Inventors: Josef Batzer, Stadtbergen (DE); Ronald Celeste, Kuehlenthal (DE)

(73) Assignee: Boewe Systec AG, Augsburg (DE)

( * ) Notice: Subject to any disclaimer, the term of this patent is extended or adjusted under 35 U.S.C. 154(b) by 736 days.

(21) Appl. No.: 11/500,787

(22) Filed: Aug. 8, 2006

(65) Prior Publication Data

US 2007/0029033 A1 Feb. 8, 2007

Related U.S. Application Data

(63) Continuation of application No. PCT/EP2005/001615, filed on Feb. 17, 2005.

(30) Foreign Application Priority Data

Feb. 20, 2004 (DE) ..... 10 2004 008 830

(51) Int. Cl.
*B43M 5/04* (2006.01)

(52) U.S. Cl. ..... 156/442.1; 156/442.2; 156/442.4; 156/486

(58) Field of Classification Search ..... None
See application file for complete search history.

(56) References Cited

U.S. PATENT DOCUMENTS

| | | | | |
|---|---|---|---|---|
| 3,474,711 | A | 10/1969 | Swinyar | |
| 3,903,544 | A * | 9/1975 | Nakamichi | 360/96.2 |
| 4,499,705 | A | 2/1985 | Russell | |
| 5,590,399 | A | 12/1996 | Matsumoto et al. | |
| 5,979,818 | A * | 11/1999 | Perini et al. | 242/521 |
| 2002/0160922 | A1 | 10/2002 | Milner et al. | |

FOREIGN PATENT DOCUMENTS

| | | |
|---|---|---|
| DE | 23 19 866 A1 | 11/1974 |
| EP | 0 493 027 A1 | 7/1992 |
| EP | 1 223 051 A1 | 8/2002 |
| GB | 944255 | 12/1963 |
| JP | 5-46496 | 6/1993 |
| JP | 2001-105790 | 4/2001 |

OTHER PUBLICATIONS

PCT/International Search Report; PCT/EP2005/001615; Aug. 31, 2005.
English Translation of PCT/EP2005/001615; Feb. 17, 2005; 4pgs.
Notices: JP05-046496,U; Claims; 8pgs.
Translation of Japanese Office Action dated Jun. 9, 2009; Patent Apl. No. 2006-553531; 2pgs.
Japanese Office Action dated Jun. 9, 2009; 2006-553531; 8pgs.

* cited by examiner

*Primary Examiner*—Richard Crispino
*Assistant Examiner*—Barbara J. Musser
(74) *Attorney, Agent, or Firm*—Beyer Law Group LLP

(57) ABSTRACT

The invention relates to an apparatus and a method for automatically closing envelopes. The apparatus contains a transport means for moving the envelopes in a transport direction, and a means for automatically folding back and closing an envelope flap. To enable accurate and reliable closing even of tightly filled envelopes even in a continuous operation duty, the means for automatically folding back and closing the envelope flap comprises several rotors which are rotatable in the transport direction of the envelopes and are movable, by means of a drive, in a manner which is transverse to the transport direction of the envelopes.

12 Claims, 2 Drawing Sheets

APPARATUS FOR AUTOMATICALLY CLOSING ENVELOPES

CROSS-REFERENCE TO RELATED APPLICATION

This application is a continuation of copending International Application No. PCT/EP2005/001615, filed Feb. 17, 2005, which designated the United States, and was not published in English and is incorporated herein by reference in its entirety.

BACKGROUND OF THE INVENTION

1. Field of the Invention

The invention relates to an apparatus and a method for automatically closing envelopes.

2. Description of Prior Art

One has already known enveloping means for filling and closing envelope automatically, or by machine, wherein the envelope flaps of the envelopes conveyed by a transport means are folded back by a stationary buffer plate and are subsequently pressed on by a press-on device. However, with this device, no parallel closing of the flap is performed, which may result, particularly with envelopes filled to a certain thickness, in that the envelope flaps are closed in an oblique manner.

To solve this problem, closing drums have already been employed which are journalled around an axis extending in parallel with the transport direction of the envelopes, and are moved in a manner which is transverse to the envelope for folding back the envelope flap. However, it is required, to this end, to interrupt the transport movement of the envelopes. Thereby, the clock performance is limited, particularly with high-performance enveloping equipment.

SUMMARY OF THE INVENTION

It is the object of the invention to provide an apparatus and a method of the type mentioned at the outset which enable accurate and reliable closing, in a continuous operation duty, even of envelopes filled to a certain thickness.

In accordance with a first aspect, the invention provides an apparatus for automatically closing envelopes with a transporter for moving the envelopes in a transport direction, and a folder for automatically folding back and closing an envelope flap, characterized in that the folder for automatically folding back and closing the envelope flap contains several rotors which are rotatable in the transport direction of the envelope and are movable, by a drive, in a manner which is transverse to the transport direction of the envelopes.

In accordance with a second aspect, the invention provides a method for automatically closing envelopes, wherein the envelopes are transported, by a transporter, in a transport direction past a folder for automatically folding back and closing an envelope flap, characterized in that during the transport of the envelope, the envelope flap is folded back and closed, along its entire length, by several rotors which are rotatable in the transport direction and are moved, in a manner which is transverse to the transport direction, across the envelope flap, which has previously been lifted up.

The inventive apparatus is characterized in that the means for folding back and closing the envelope flap in an automated manner contains several moveable rotors that are rotatable in the transport direction of the envelope and are moveable, by means of a drive, in a manner which is transverse to the transport direction of the envelopes.

A crucial advantage of the inventive configuration is that envelopes filled to have both small and large thicknesses may be closed by machine without delay and without interrupting the transport. Above all, the inventive apparatus solves the problem of the envelope height and of the large filling height in the case of thick filling. Without stopping, during transport, the envelope flap, which has been moistened and, prior to that, lifted up, is folded back, and the envelope is closed. Thus, no stopping location, no braking and no renewed accelerating are required. Thus, automated closing of envelopes may also be effected at high speeds.

In a particularly expedient embodiment of the invention, the rotors are configured in the form of drums which are journalled on axes which extend in a manner which is transverse to the transport direction of the envelopes. At their ends which point to the envelope flap, the drums are rounded in an advantageous manner, or have an inclination. Thus, it is possible to drive the rotor onto the envelope flap in a trouble-free manner.

In accordance with a further advantageous implementation, the rotors comprise a front area having a low frictional constant, and a back area having a high frictional constant. Driving the rotors onto the envelope flap may thus be effected through the areas having low frictional constants, whereby the rotors may take on the transport speed of the envelope. Through areas having high frictional constants, which subsequently engage the envelope flap, the envelope flap is pushed across the envelope to the flap break in a uniform and parallel manner, and is closed. In this manner, a force is exerted on the envelope flap which acts in the closing direction and which serves to not only fully close the envelope flap but also to insert any sheets which have not been fully inserted into the envelope, right down to the bottom of the envelope.

In a configuration which is simple in construction and low in cost, the different frictional constants of the rotors may be achieved in that the rotor consists of plastic and exhibits, at its back area, external frictional elements, e.g. in the form of rubber rings or the like.

In order to enable the rotors to be driven onto the envelope flap in a manner which is as free from trouble as possible, and in order to prevent the envelopes from slorocker down, the carrier has arranged thereon a spacer which is embodied, for example, as a distance drum, and by means of which the rotors are kept at a predefined distance from the base.

The inventive method is characterized in that, during the transport of the envelopes, the envelope flap is folded back and closed, along its entire length, by several rotors which are rotatable in the transport direction and are moved, in a manner transverse to the transport direction, across the envelope flap, which has previously been lifted up.

BRIEF DESCRIPTION OF THE DRAWINGS

These and other objects and features of the present invention will become clear from the following description taken in conjunction with the accompanying drawing, in which.

DESCRIPTION OF PREFERRED EMBODIMENTS

Figure 1:
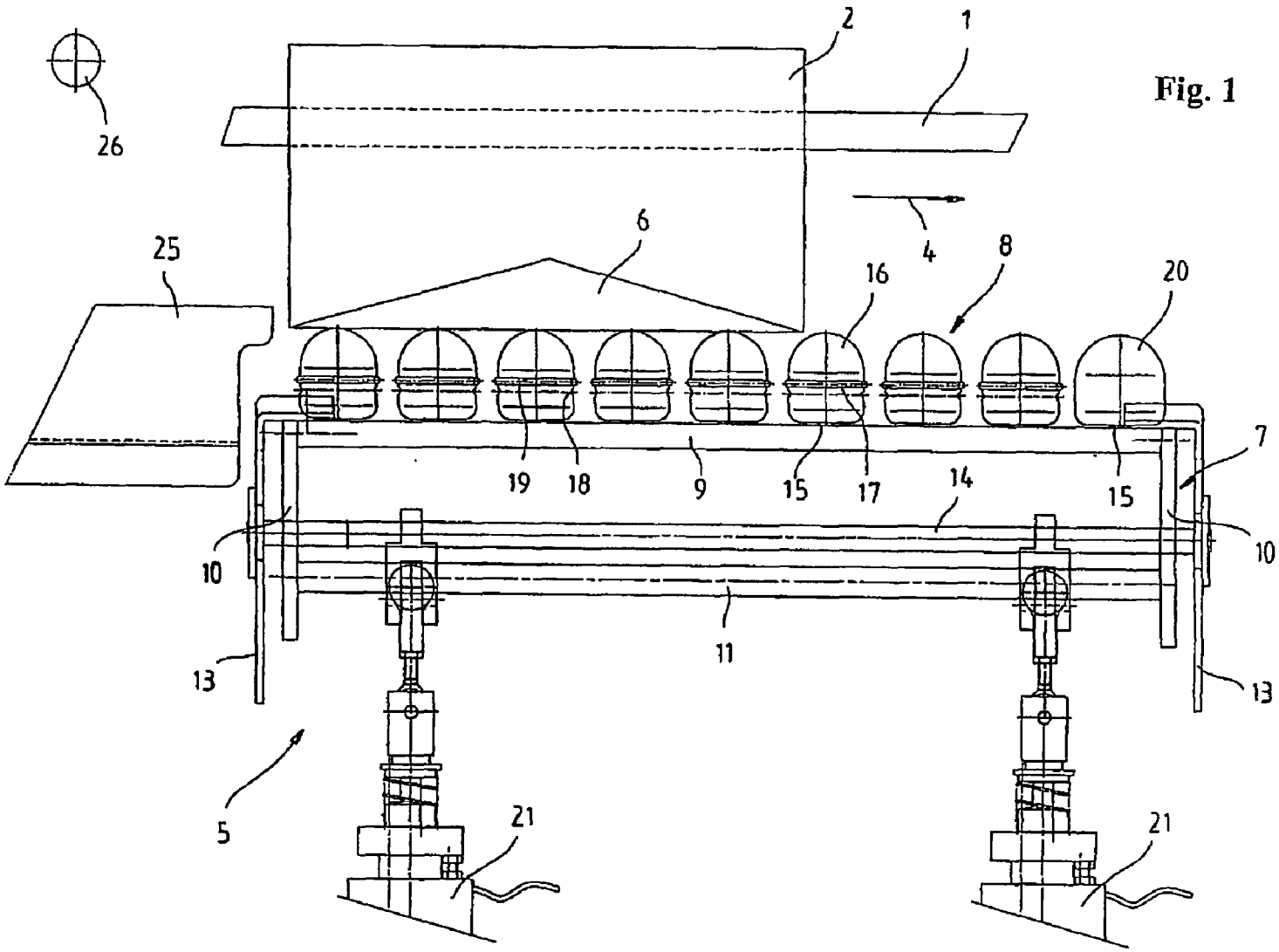
FIG. 1 is an inventive apparatus for automatically closing envelopes, in a top view.
Figure 2:
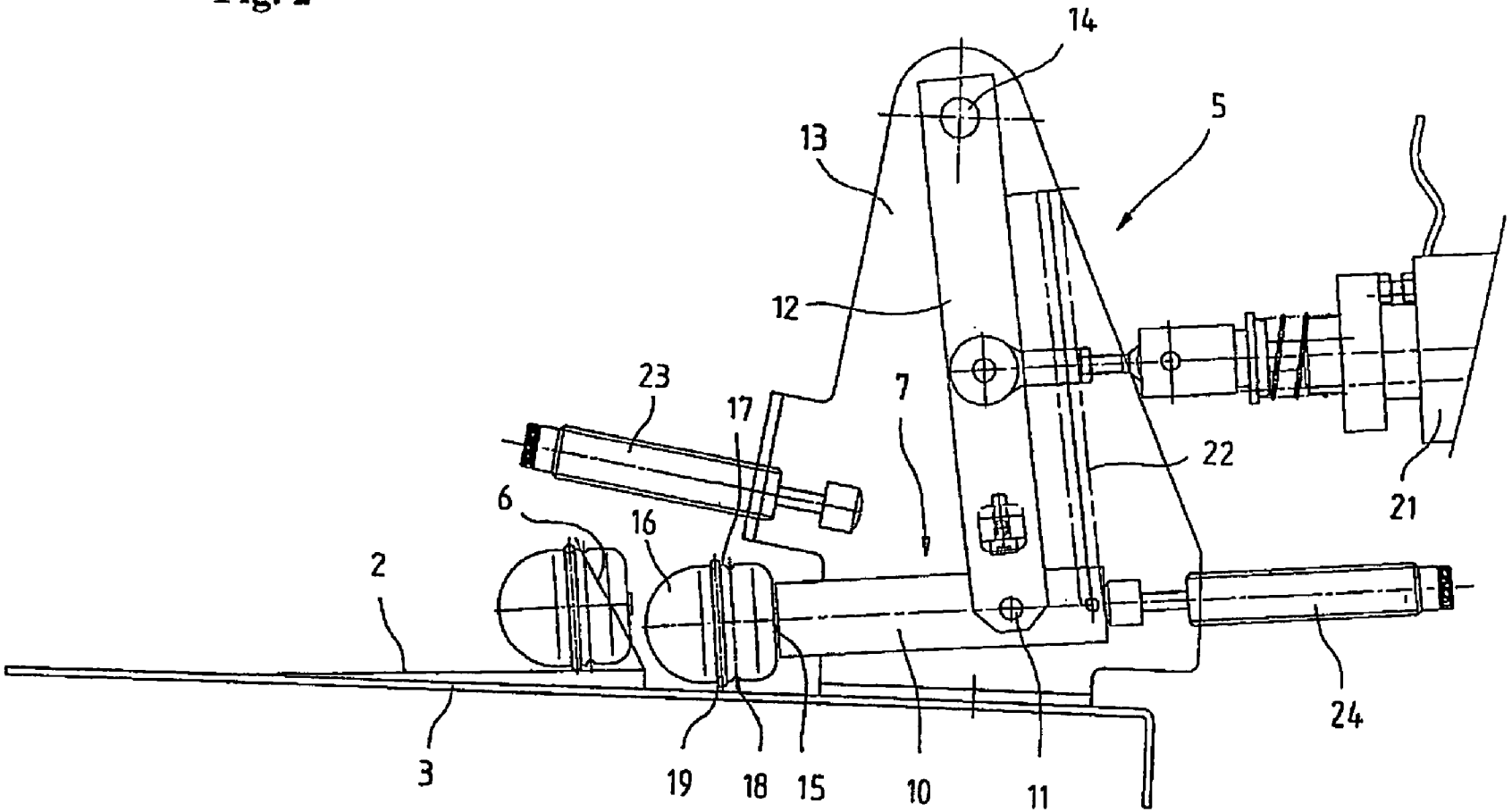
FIG. 2 is the apparatus depicted in FIG. 1 for automatically closing envelopes, in a side view.

The apparatus for automatically closing envelopes which has been schematically represented in FIGS. 1 and 2 contains a transport means 1 which is embodied, for example, as a conveyer belt, and by means of which several envelopes 2 which previously have been filled with the respective content in a filling station are successively conveyed, in their longitudinal direction, in a transport direction characterized by arrow 4 in FIG. 1 on a base 3 shown in FIG. 2. A means 5 for automatically folding back and closing an envelope flap 6 on the previously filled envelopes 2 is arranged on base 3 in parallel with transport means 1.

Means 5 for automatically folding back and closing the envelope flap 6 contains a carrier 7 which is movable in a manner which is transverse to the transport direction of the envelopes 2 and which has several rotors 8 arranged thereon which are mutually successive in the transport direction of the envelopes 2. As may be seen from FIG. 2, carrier 7 contains a rail-shaped front portion 9, which extends in parallel with the transport direction of the envelopes 2, and two side portions 10 which are at right angles in relation to part 9 and are interconnected in the back area by a connecting rod 11. By means of two spaced-apart rockers 12, carrier 7 is articulated so as to swivel around an upper axis of rotation 14 extending between two lateral supports 13. The two lateral supports 13 are attached to base 3.

In the embodiment shown, rotors 8 are configured in the form of drums which are rounded in the shape of a hemisphere at their front ends facing envelope flap 6.

Rotors 8 are journalled on axes 15 which extend transverse to the transport direction of envelopes 2. The axes 15 are mounted, in a manner which is transverse to the transport direction of envelopes 2 and such that they protrude forward toward envelope flap 6, on front part 9 of carrier 7 which extends in parallel with transport means 1. Rotors 8 comprise a front area 16 having a low frictional constant, and a back area 17 having a high frictional constant. To this end, rotor 8 expediently consists of a plastic (e.g. POM) having a low coefficient of friction. In the back area of rotors 8, revolving ring grooves 18 for one or several friction elements 19 consisting of rubber or the like are introduced in the form of O-rings. Thereby, rotor 8 has a higher frictional constant in this area. By selecting the number of frictional elements 19 accordingly, the frictional constant at the respective rotors 8 may be altered. A distance drum 20 which has a larger external diameter than rotors 8 and bears on base 3 is mounted on the last axis 15 as seen in the transport direction. This distance drum 20 guarantees that rotors 8 have a predefined distance from base 3, as is shown in FIG. 2.

In accordance with FIG. 2, the two mutually spaced-apart rockers 12 are articulated on connecting rod 11 with their lower ends, and on rotation axis 14 with their upper ends. On the two rockers 12, a drive 21 configured, for example, as a lifting magnet, engages between the upper and lower ends, it being possible, by means of said drive 21, to move carrier 7 with the rotors 8 arranged thereon, for folding back envelope flap 6, in a manner which is transverse to the transport direction of envelopes 2 between a back initial position shown in FIG. 1 and a front closing position indicated by only one rotor. A spring arrangement 22, by means of which the distance drum 20 arranged on the carrier 7 is pressed onto the base acts on the ends of the two lateral parts 10, the ends projecting backward opposite connecting rod 11. In addition, front and back end-position dampers 23 and 24 are provided by means of which the formation of oscillations while swiveling the carrier 7 between the initial position and the closing position is prevented.

The above-described apparatus operates as follows:

The envelope 2 previously filled in a filling station is transported, by transport means 1, in the longitudinal direction along means 5 for automatically folding back the envelope flap 6. By means of a stationary folder 25 arranged upstream from means 5 in the transport direction, the envelope flap 6, facing the rotors 8, of envelope 2 is slightly lifted beforehand. As soon as envelope 2 has reached a position, shown in FIG. 1, wherein envelope flap 6 may come into contact, along its entire length, with rotors 8, the two drives 21 are activated such that carrier 7 passes from its initial backward position to the front; closing position. Control of the two drives 21 is effected as a function of a sensor 26 connected upstream from means 5 which detects the arrival of an envelope 2 to be closed, and initiates actuation of the two drives 21 after a predetermined lapse of time. However, sensor 26 may also be arranged such that control is effected at the same time as the detection of the leading edge of envelope 2.

When carrier 7 is swiveled into the closing position, rotors 8 initially come to lie, by means of their area 16 with the low frictional constant, on envelope flap 6, whereby rotors 8 are guided onto envelope 2 and take on its transport speed. After being driven, for a short time, onto envelope flap 6, areas 17 having the high frictional constant, start to operate and exert, onto envelope flap 6, a force in the closing direction which also causes any content which may still be projecting to be pressed into the envelope. Envelope flap 6 is pushed, right up to the flap break, across envelope 2 in a uniform and parallel manner, and is closed. The rail-shaped front part 9 of carrier 7 having the rotors 8 arranged thereon is longer than envelope 2, so that during swiveling of carrier 7 into the closing position, the entire envelope flap 6 is constantly in contact with rotors 8 even while envelope 2 is transported further. The distance drum 20 ensures that the rotors 8 do not slow down the envelope 2 while envelope 2 is introduced into means 5. Once envelope 2 has left distance drum 20, carrier 7 returns to its initial position.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. An apparatus for automatically closing envelopes, the apparatus comprising:

an envelope transporter for moving the envelopes in a transport direction; and an envelope flap folder for automatically folding back and closing an envelope flap, wherein the envelope flap folder for automatically folding back and closing the envelope flap comprises a plurality of rotors for engagement with an envelope flap, each of the plurality of rotors being rotatable around a rotation axis which is transverse to the transport direction of the envelopes, and means coupled to the rotors for moving the rotors in a direction approximately along the rotation axis of the rotors between a back initial position and a front closing position for pushing the envelope flap across the envelope in a uniform manner, thereby automatically folding back and closing the envelope flap.

2. The apparatus as claimed in claim 1, wherein the rotors are configured as drums which are journalled on axes arranged on a carrier in a manner which is transverse to the transport direction of the envelope.

3. The apparatus as claimed in claim 1, wherein at their front ends facing the envelope flap, the rotors are rounded or have an inclination.

4. The apparatus as claimed in claim 1, wherein the rotors comprise a front area having a low frictional constant, and a back area having a high frictional constant.

5. The apparatus as claimed in claim 4, wherein the rotors comprise one or several frictional elements in the back areas.

6. The apparatus as claimed in claim 5, wherein the frictional elements are frictional rings placed onto the rotors.

7. The apparatus as claimed in claim 2, wherein a distance drum is mounted on the carrier.

8. The apparatus as claimed in claim 2, wherein by rockers, the carrier is articulated so as to swivel about an axis of rotation extending between supports.

9. The apparatus as claimed in claim 2, wherein the carrier is movable, by the drive, between a back initial position and a front closing position.

10. The apparatus as claimed in claim 8, wherein at the supports, back and front end-position dampers are arranged for damping shocks of the carrier in the movement between the back initial position and the front closing position.

11. The apparatus as claimed in claim 2, wherein the carrier contains a rail-shaped front part parallel to the transport direction of the envelopes and having the rotors arranged thereon.

12. The apparatus as claimed in claim 1, wherein the rotors are pressed onto the envelope flap by a spring arrangement.

* * * * *